US010281151B2

(12) United States Patent
Smith

(10) Patent No.: US 10,281,151 B2
(45) Date of Patent: May 7, 2019

(54) GAS HEATER

(71) Applicant: BROMIC PTY LTD, Silverwater, New South Wales (AU)

(72) Inventor: Scott Smith, West Pennant Hills (AU)

(73) Assignee: BROMIC PTY LTD, Silverwater, New South Wales (AU)

( * ) Notice: Subject to any disclaimer, the term of this patent is extended or adjusted under 35 U.S.C. 154(b) by 485 days.

(21) Appl. No.: 14/414,895

(22) PCT Filed: Jun. 29, 2013

(86) PCT No.: PCT/AU2013/000715

§ 371 (c)(1),
(2) Date: Jan. 15, 2015

(87) PCT Pub. No.: WO2014/012131

PCT Pub. Date: Jan. 23, 2014

(65) Prior Publication Data

US 2015/0167973 A1 Jun. 18, 2015

(30) Foreign Application Priority Data

Jul. 16, 2012 (AU) ..... 2012903030

(51) Int. Cl.
*F23N 5/10* (2006.01)
*F24H 9/20* (2006.01)
(Continued)

(52) U.S. Cl.
CPC ..... *F23N 5/102* (2013.01); *F23D 14/725* (2013.01); *F23N 5/105* (2013.01); *F23N 5/242* (2013.01);
(Continued)

(58) Field of Classification Search
CPC ..... F23N 5/102; F23C 6/02; F23D 14/725
(Continued)

(56) References Cited

U.S. PATENT DOCUMENTS 2,710,181 A 6/1955 Parrett
2,959,219 A 11/1960 Hajny
(Continued)

FOREIGN PATENT DOCUMENTS

CN 1061271 5/1992
EP 0737283 12/1999
(Continued)

OTHER PUBLICATIONS

Thermocouples. Learning Electronics. Sep. 1, 2010. https://web.archive.org/web/20100901023129/http://www.learningelectronics.net/vol_1/chpt_9/5.html.*

*Primary Examiner* — Avinash A Savani
*Assistant Examiner* — Rabeeul I Zuberi
(74) *Attorney, Agent, or Firm* — Mark M. Friedman

(57) ABSTRACT

A gas heater (10) includes heater burner (16). Heat is generated by the ignition of gas supplied to the burner via conduits (20). A solenoid gas safety valve (22), when provided with a threshold electrical current, is maintained in an open condition allowing passage of gas to the burners. When not provided with that threshold current, the valve is closed, preventing the passage of gas. An electrical current generator (28) includes spaced apart thermocouple devices (30, 32). Due to a combined electrical current generation by the thermocouples, the current generator can generate electrical current at least said threshold current even if any one of the thermocouple devices does not generate the threshold electrical current.

12 Claims, 1 Drawing Sheet

(51) Int. Cl.

| | |
|---|---|
| ***F23N 5/24*** | (2006.01) |
| ***F24C 3/12*** | (2006.01) |
| ***F24H 3/00*** | (2006.01) |
| ***F23D 14/72*** | (2006.01) |

(52) U.S. Cl.
CPC ..... *F23N 5/245* (2013.01); *F24C 3/122* (2013.01); *F24H 3/006* (2013.01); *F24H 9/2085* (2013.01); *F24H 2240/08* (2013.01)

(58) Field of Classification Search
USPC ..... 431/80
See application file for complete search history.

(56) References Cited

U.S. PATENT DOCUMENTS 5,391,074 A * 2/1995 Meeker ..... F23N 5/105 431/80
5,403,183 A * 4/1995 Andersson ..... F23D 14/725 431/27
6,033,211 A * 3/2000 Meyer ..... F23D 14/145 126/92 AC
2002/0134322 A1* 9/2002 Dolan ..... F23N 5/242 122/504
2004/0154551 A1* 8/2004 Brice ..... A01K 31/19 119/320
2006/0275720 A1* 12/2006 Hotton ..... F23N 5/102 431/80
2011/0045423 A1* 2/2011 Young ..... F23Q 9/04 431/258

FOREIGN PATENT DOCUMENTS

| | | |
|---|---|---|
| EP | 0837283 | 12/1999 |
| GB | 452315 | 8/1936 |
| TW | 231735 | 10/1994 |
| WO | 1982/002760 | 1/1982 |
| WO | 2011/106824 | 9/2011 |

* cited by examiner

GAS HEATER

FIELD OF THE INVENTION

This invention relates to gas heaters. More specifically, the invention relates to gas heaters having thermocouple actuated gas safety shut-offs.

BACKGROUND TO THE INVENTION

Gas heaters have burners which are adapted for heating by means of flames which are fuelled by gas supplies of the heaters. If the flame of such a burner were to become extinguished, for example due to wind, and if gas were to be supplied to such burners even after they became extinguished, the gas would not be consumed by the burners, and could thus pose a serious fire or explosion hazard, or could be hazardous if inhaled.

Many conventional outdoor gas heaters have ignition systems, and single thermocouple probes for actuating gas safety shut-off valves. Such valves operate to shut off gas supplies to the burners of the heaters in the event that the flames of the burners become extinguished.

The thermocouple probes operate according to the "Seebeck" principal. According to this principle, a micro-current is generated when a temperature differential is present in a closed circuit consisting of wires made of two dissimilar metals.

In the case of a heater gas safety shut-off valve, such a micro-current is used to operate solenoid valves which are for allowing, or shutting off, the supply of gas to the heater burner. Such a valve is biased to a closed position for preventing the supply of gas, but the micro-current of the thermocouple, if above a threshold current applicable to the solenoid, can maintain the solenoid valve in an open condition to allow the supply of gas to the heater burner.

It is the heat of the burner itself acting directly on the thermocouple which causes the temperature differential required for the thermocouple to generate the micro-current. If the flame of the burner is extinguished, that temperature differential will disappear or at least diminish, thus causing a reduction or termination of the micro-current, and this in turn causes the solenoid valve to close thereby shutting off the supply of gas.

Such gas heaters are typically used for outdoor heating. As a result, the heaters are often exposed to the weather, and can be affected by wind. In particular, during windy conditions, for example conditions in which the wind speed is around 5 to 12 kilometers per hour, the burner flame can flicker, and thus be unsteady, and produce less heat. If the heat sensed by the thermocouple reduces, this has the effect of lowering the micro-current generated by the thermocouple. If the current reduces to a value below the solenoid current threshold, the solenoid will close and this will shut off the supply of gas to the heater burner. An operator would then have to manually relight the burner, and this can be time consuming and inconvenient, especially if the heater needs to be relighted repeatedly, and if the heater is being used at busy venues such as restaurants, pubs and the like.

One way of addressing this problem is to move the heater to a less windy position. However, this itself can be inconvenient, and possibly even dangerous, and may result in heat not being provided in an area where it is most required.

It is an object of the present invention to ameliorate or overcome disadvantages of the prior art or to propose a useful alternative thereto.

SUMMARY OF THE INVENTION

According to the invention there is provided a gas heater including:

- at least one heater burner having an operational condition in which heat is generated by the ignition of gas supplied to the burner;
- at least one conduit for directing gas from a gas supply to the at least one heater burner;
- a solenoid gas safety valve device having a valve electrical connector and being adapted, when provided via said valve connector with at least a threshold amount of electrical current, to be maintained in an open condition to allow passage of gas from a said gas supply along the at least one conduit to the at least one heater burner, and when not provided with at least said threshold amount of current, to be in a closed condition thereby preventing such passage of gas; and
- an electrical current generator which is connected to the valve device via said valve connector and which includes a plurality of thermocouple devices spaced apart from one another, the electrical current generator being configured, due to a combined electrical current generation by said thermocouple devices, to generate electrical current of at least said threshold amount for provision to the valve device via the connector, even if any one of the thermocouple devices does not generate electrical current of at least said threshold amount.

In a preferred embodiment, if none of the thermocouple devices generates electrical current, the electrical current generator does not generate an amount of electrical current of at least said threshold amount, such that the solenoid gas valve is in the closed condition.

In a preferred embodiment, the plurality of thermocouple devices are electrically connected to one another in a series configuration.

Then, preferably, each thermocouple device has a first electrical connector and a second electrical connector, wherein the first electrical connector of a first of the thermocouple devices is earthed, and wherein, for each pair of interconnected thermocouple devices, the second electrical connector of one of those thermocouple devices is connected to the first electrical connector of the other one of those thermocouple devices.

Preferably, the second electrical connector of a last of the thermocouple devices in said series configuration is connected to the valve connector of the solenoid valve device.

In a preferred embodiment, said valve connector of the solenoid valve device is a first valve connector, the valve device having a second electrical valve connector which is earthed.

In a preferred embodiment, the gas heater includes a metal heater chassis, wherein the first electrical connector of said first of the thermocouple devices is earthed to said chassis.

Preferably, the second valve connector is earthed to said chassis.

In a preferred embodiment, the heater includes at least one wind diffuser, each of the thermocouple devices being disposed between the at least one heater burner and the at least one diffuser.

BRIEF DESCRIPTION OF THE DRAWINGS

Preferred embodiments of the invention will now be described, by way of example only, with reference to the accompanying drawings in which.

DETAILED DESCRIPTION

Figure 1:
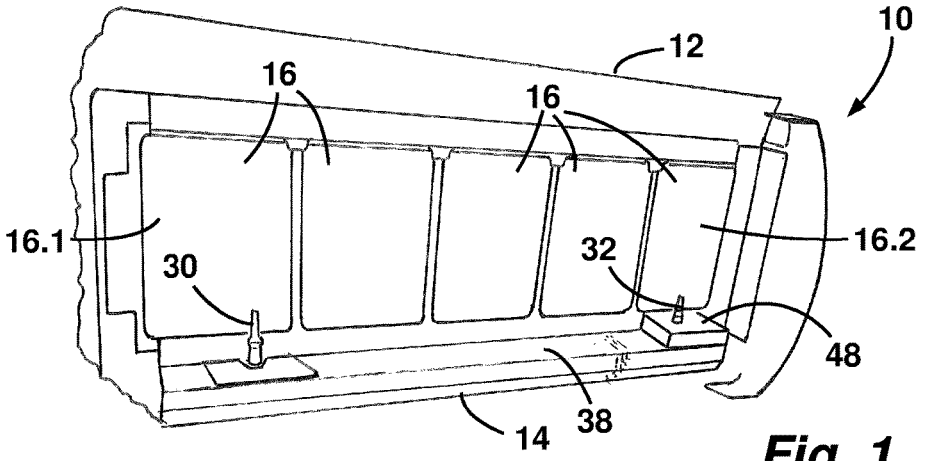
FIG. 1 is a perspective view of part of a gas heater.

Referring to the drawings, there is shown a part of gas heater 10. The heater 10 includes a heater head generally referenced 12. The heater head 12 includes a metal chassis 14 and heater burners 16.

A supply of gas 18 in the form of a gas container, is provided and is adapted to provide gas to the burners 16 along conduits 20 in the form of gas pipes.

The heater 10 also includes an electromagnetic gas safety device in the form of a solenoid valve 22. The gas safety solenoid valve 22 has an open condition in which it allows gas to flow from the gas supply 18 to the burners 16, and a closed condition in which the valve shuts off this flow.

The gas safety solenoid valve 22 is biased to its closed position by a spring (not shown). It is provided with a first electrical connector 24 for connection to a device capable of generating an electrical current.

The gas safety solenoid valve 22 also has a metallic solenoid body 26. The solenoid body 26 serves as a second electrical connector of the gas safety solenoid valve 22, to enable the valve to form part of an electrical circuit. The solenoid gas safety valve 22 is mounted on the chassis 14 (the manner of mounting not being shown), with the effect that the solenoid body 26 is electrically earthed to the chassis as indicated at 27.

Figure 3:
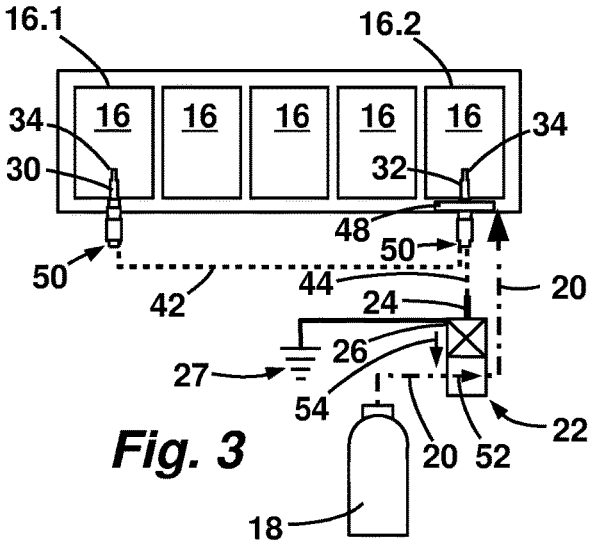
FIG. 3 is a schematic front view of the part of the heater of FIG. 1, together with a gas supply and solenoid valve.

When the gas safety solenoid valve 22 is provided with a sufficient electrical current via its first connector 24, the electromagnetic force induced in the solenoid by the current is sufficient to overcome the biasing force of the spring that urges the solenoid valve to its closed position. By means of such current, the gas safety solenoid valve 22 can be maintained in its open position as shown in FIG. 3.

The electrical current above which there will be sufficient electromagnetic force to overcome the biasing force of the spring is referred to herein as a threshold current.

The heater 10 includes an electrical current generator, generally referenced 28, which includes a pair of thermocouple devices 30 and 32. Each thermocouple device 30, 32 has a probe 34, and a metallic body or shell 36. The thermocouple devices 30, 32 are mounted on a portion 38 of the chassis 14, with the probes 34 projecting from that portion of the chassis so as to be positioned adjacent the two outer burners 16 (referenced as 16.1 and 16.2) as shown in FIG. 1. These probes 34 constitute sensors for sensing heat from the burners 16.1 and 16.2.

While the probes 34 are positioned adjacent to the two outer burners 16.1, 16.2 in the embodiment described, in other embodiments (not shown), the probes may be adjacent to other ones of the burners 16.

Each thermocouple device 30, 32 has two electrical connectors, a first connector being constituted by the shell 36, and a second connector 40.

Figure 2:
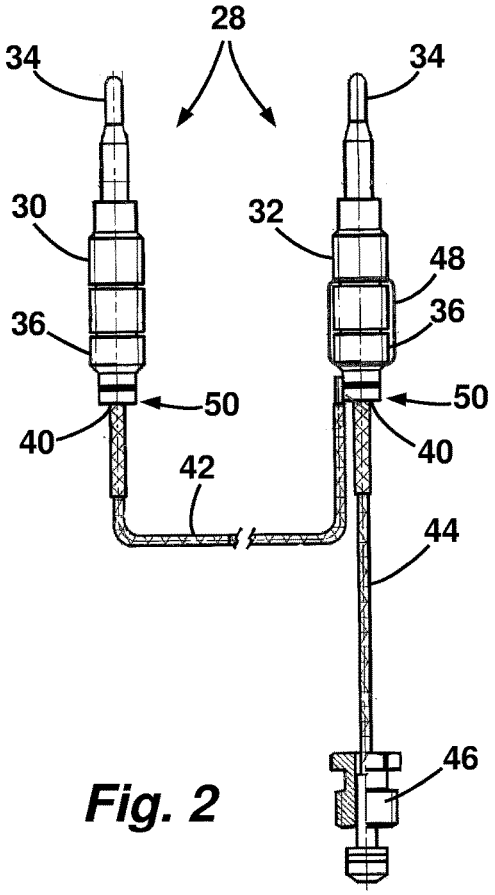
FIG. 2 is a front view of a pair of thermocouple devices of the heater of FIG. 1, the thermocouple devices being electrically connected in series.

As shown in FIG. 2, the second connector 40 of the left hand thermocouple device 30 is connected, by a wire 42, to the first connector of the right hand thermocouple device 32, that is, to the shell 36 of that device. It is mechanically bonded to that shell 36.

The second connector 40 of the right hand thermocouple device 32 is connected by a wire 44, and via an electrical connector 46, to the first connector 24 of the gas safety solenoid valve 22.

The shell 36 of the left hand thermocouple device 30 as shown is in contact with the portion 38 of the chassis 14, and is thus electrically earthed to the chassis. However, the shell 36 of the right hand thermocouple device 32 is mounted on the portion 38 of the chassis 14 by way of an electrical and thermal insulator 48. Thus, the right hand thermocouple device 32 is not electrically connected to the chassis 14, and is therefore electrically connected in series to the left hand thermocouple device 30.

The insulator 48, according to one preferred embodiment, is an Alumina-Oxide ceramic insulator, but other suitable forms of insulator may be used instead.

With the shell 36 of the left hand thermocouple device 30 and the body 26 of the gas safety solenoid valve 22 both being earthed and therefore of the same electric potential, the combination of the two thermocouple devices 30, 32, the gas safety solenoid valve 22 and the connecting wires 42 and 44 constitute a closed electric circuit, with the two thermocouple devices being connected in series. It will be appreciated that the insulator 48 is essential for this circuit, because, in the absence of the insulator, the right hand thermocouple device 32 would be earthed to the chassis 14 and a series circuit would not be formed.

Each thermocouple device 30, 32 is adapted to generate an electrical current when experiencing a temperature differential between its probe 34 and the opposite end 50 of the respective thermocouple device. As the thermocouple devices 30, 32 are connected in series, the total electrical current generated is essentially the cumulative current generated by the two thermocouple devices.

According to a preferred embodiment, when the heater burners 16 are ignited and burning, and the ambient temperature of the location in which the heater 10 is used is within the range of operational temperatures for which the heater is designed, the temperature differential between the probe 34 of each thermocouple device 30, 32 and the opposite end 50 of the thermocouple device, due to the heat experienced from the relevant adjacent burner 16, is sufficient for that thermocouple device alone to generate at least the threshold current.

Thus, if either one of the thermocouple devices 30, 32 is caused to generate such a current while the other is not caused to generate such a current (even if the other thermocouple device generates no current at all), the amount of current generated by the first-mentioned thermocouple device is at least the threshold current, and is thus sufficient for the electrical current generating source 28 to maintain the gas safety solenoid valve 22 in its open position.

It will therefore be appreciated that the supply of electrical current sufficient to keep the gas safety solenoid valve 22 in its open position, and hence to allow the heater burners 16 to operate, is provided by the heater 10 itself, and not by any source of current separate from the heater.

In use, once the heater burners 16 are ignited, the heat generated by the burners heats the probes 34 of the thermocouple devices 30, 32, and this causes these devices to generate electric current greater than the threshold current. This current causes the gas safety solenoid valve 22 to be maintained in an open position, thus allowing the supply of gas along the conduit 20 to the burners 16, as indicated by the arrow 52.

If, for example, a gust of wind causes the probe 34 of one of the thermocouple devices 30, 32 to be momentarily cooled, either directly or by causing the flame of the adjacent burner 16 to flicker, then the current generated by that thermocouple device will reduce, and may even reduce to a value significantly less than the threshold current. However, provided the probe 34 of the other thermocouple device 30, 32 remains heated by the burner 16 adjacent to it, that thermocouple device will generate electric current exceeding the threshold current, and that current will therefore cause the gas safety solenoid valve 22 to be maintained in an open position. This allows the supply of gas along the conduit 20 to the burners 16 to continue and hence for the burners to remain ignited.

Thus the gas (or most of the gas) will be consumed by the burners 16 and the drop in current produced by the relevant thermocouple device 30, 32 should not significantly increase dangers associated with that gas, such as fire hazards, or dangers of inhalation.

On the other hand, should the flames of all of the burners 16, and in particular the two burners 16.1, 16.2 adjacent to the two thermocouple devices 30, 32 become extinguished, then the current generated by both of the thermocouple devices will drop sufficiently such that their combined generated current will be below the threshold current. This will allow the bias of the gas safety solenoid valve 22 to cause the valve to move to its closed position as indicated by the arrow 54, thereby shutting off the supply of gas to the burners 16.

The thermocouple devices 30, 32 are spaced apart from one another. Thus, while it is not impossible for a gust of wind to affect the flames of both the burners 16.1, 16.2 which are adjacent to the thermocouple devices to an extent sufficient to cause the gas safety solenoid valve 22 to shut off the gas supply, this is relatively unlikely from a statistical point of view.

Figure 4:
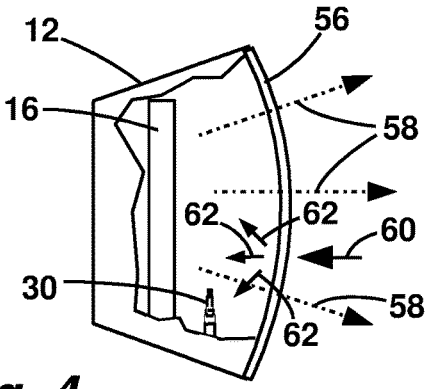
FIG. 4 is a schematic side view, shown partly cut away, of the part of the heater of FIG. 1.

Referring to FIG. 4, the heater 10 is provided with a wind-diffusing mesh cover 56 which extends over the burners 16. The thermocouple devices 30, 32 are positioned between the mesh cover 56 and the burners 16.1, 16.2. The mesh cover 56 has openings for allowing the radiation of heat from the burners 16 to the area adjacent to the heater 10, as indicated by the arrows 58. However, wind impacting on the heater 10 and its burners 16, including wind striking the mesh cover 56 directly, as indicated by the arrow 60, is caused to be diffused by the mesh cover 56, as indicated by the arrows 62. This assists in reducing the extent to which the wind will affect the flames of the burners 16, including the extent to which the flames are caused to flicker due to the wind, and diffuses wind that might otherwise strike the thermocouple devices directly. This, in turn, assists in minimising the cooling effect that the wind has on the thermocouple devices 30, 32, and thus minimises the extent to which the current generated by the thermocouple devices is reduced.

Although the invention is described above in relation to preferred embodiments, it will be appreciated by those skilled in the art that it is not limited to those embodiments, but may be embodied in many other forms.

For example, according to one embodiment, when the heater 10 is used within the range of operational temperatures as mentioned above, the amount of current produced by each thermocouple device 30, 32 alone is less than the threshold current required to keep the gas safety solenoid valve 22 in its open condition. However, in many or most wind conditions, the amount of cooling of each thermocouple device 30, 32 will not be sufficient to cause the device to stop generating current completely. According to this embodiment, when the heater 10 is functioning within the operational conditions for which it has been designed, the cumulative current of the two thermocouple devices 30, 32, even if the current produced by one of those devices is reduced due to the wind, will exceed the threshold current, and can thus keep the gas safety solenoid valve 22 in its open condition.

The invention claimed is:

1. A gas heater including:

at least one heater burner having an operational condition in which heat is generated by the ignition of gas supplied to the burner;

at least one conduit for directing gas from a gas supply to the at least one heater burner;

a solenoid gas safety valve device having a valve electrical connector and being adapted, when provided via said valve connector with at least a threshold amount of electrical current, to be maintained in an open condition to allow passage of gas from a said gas supply along the at least one conduit to the at least one heater burner, and when not provided with at least said threshold amount of current, to be in a closed condition thereby preventing such passage of gas; and an electrical current generator which is connected to the valve device via said valve connector and which includes a plurality of thermocouple devices spaced apart from one another, each of the thermocouple devices being located to be in the proximity of, and capable of being heated by, at least one heater burner of the at least one heater burner and to generate electric current on being so heated, the electrical current generator being configured, due to a combined amount of electrical current generation by said thermocouple devices, to generate electrical current of at least said threshold amount for provision to the valve device via the connector, even if any one of the thermocouple devices generates an amount of electrical current within a range from a zero amount of current to a higher amount less than said threshold amount.

2. A gas heater according to claim 1, wherein, if none of the thermocouple devices generates electrical current, the electrical current generator does not generate an amount of electrical current of at least said threshold amount, such that the solenoid gas valve is in the closed condition.

3. A gas heater according to claim 1, wherein the plurality of thermocouple devices are electrically connected to one another in a series configuration.

4. A gas heater according to claim 3, wherein each thermocouple device has a first electrical connector and a second electrical connector, wherein the first electrical connector of a first of the thermocouple devices is earthed, and wherein, for each pair of interconnected thermocouple devices, the second electrical connector of one of those thermocouple devices is connected to the first electrical connector of the other one of those thermocouple devices.

5. A gas heater according to claim 4, wherein the second electrical connector of a last of the thermocouple devices in said series configuration is connected to the valve connector of the solenoid valve device.

6. A gas heater according to claim 4, wherein said valve connector of the solenoid valve device is a first valve connector, the valve device having a second electrical valve connector which is earthed.

7. A gas heater according to claim 6, including a metal heater chassis, wherein the first electrical connector of said first of the thermocouple devices is earthed to said chassis.

8. A gas heater according to claim 7, wherein said second valve connector is earthed to said chassis.

9. A gas heater according to claim 1, wherein the heater includes at least one wind diffuser, each of the thermocouple devices being disposed between the at least one heater burner and the at least one diffuser.

10. A gas heater according to claim 1, wherein each of said plurality of thermocouple devices is positioned adjacent a respective heat collecting region of said at least one heater burner.

11. A gas heater according to claim 1, wherein said at least one heater burner includes a plurality of heater burners and wherein each of said plurality of thermocouple devices is positioned adjacent a respective said heater burner.

12. A gas heater including:

at least two heater burners having operational conditions in which heat is generated by the ignition of gas supplied to the burners;

at least one conduit for directing gas from a gas supply to the at least two heater burners;

a solenoid gas safety valve device having a valve electrical connector and being adapted, when provided via said valve connector with at least a threshold amount of electrical current, to be maintained in an open condition to allow passage of gas from a said gas supply along the at least one conduit to the at least two heater burners, and when not provided with at least said threshold amount of current, to be in a closed condition thereby preventing such passage of gas; and an electrical current generator which is connected to the valve device via said valve connector and which includes at least two thermocouple devices, each of said at least two thermocouple devices positioned to sense heat from a respective discrete heater burner, the electrical current generator being configured, due to a combined amount of electrical current generation by said thermocouple devices, to generate electrical current of at least said threshold amount for provision to the valve device via the connector, even if any one of the thermocouple devices generates an amount of electrical current within a range from a zero amount of current to a higher amount less than said threshold amount.

* * * * *